US011167204B1

(12) United States Patent
Farley

(10) Patent No.: US 11,167,204 B1
(45) Date of Patent: Nov. 9, 2021

(54) LIGHTED SHUFFLEBOARD WEIGHT

(71) Applicant: Indian Industries, Inc., Evansville, IN (US)

(72) Inventor: Patrick Farley, Bay Shore, NY (US)

(73) Assignee: Indian Industries, Inc., Evansville, IN (US)

( * ) Notice: Subject to any disclaimer, the term of this patent is extended or adjusted under 35 U.S.C. 154(b) by 0 days.

(21) Appl. No.: 16/947,518

(22) Filed: Aug. 5, 2020

(51) Int. Cl.

| | |
|---|---|
| ***A63F 7/40*** | (2006.01) |
| ***A63F 7/00*** | (2006.01) |
| ***F21V 33/00*** | (2006.01) |
| ***F21S 9/02*** | (2006.01) |
| ***F21V 23/04*** | (2006.01) |
| ***F21V 9/08*** | (2018.01) |
| ***F21V 3/04*** | (2018.01) |
| *F21W 131/40* | (2006.01) |
| *F21Y 115/10* | (2016.01) |
| *F21Y 113/10* | (2016.01) |

(52) U.S. Cl.
CPC ..... *A63F 7/40* (2013.01); *A63F 7/0005* (2013.01); *F21S 9/02* (2013.01); *F21V 3/049* (2013.01); *F21V 9/08* (2013.01); *F21V 23/04* (2013.01); *F21V 33/008* (2013.01); *A63F 2007/4068* (2013.01); *F21W 2131/40* (2013.01); *F21Y 2113/10* (2016.08); *F21Y 2115/10* (2016.08)

(58) Field of Classification Search
CPC .. A63F 7/40; A63F 7/0005; A63F 2007/4068; F21V 3/049; F21V 33/008; F21V 23/04; F21V 9/08; F21S 9/02; F21Y 2115/10; F21Y 2113/10; F21W 2131/40
See application file for complete search history.

(56) References Cited

U.S. PATENT DOCUMENTS

| | | | | |
|---|---|---|---|---|
| 2,998,251 A | | 8/1961 | Mcshane | |
| 3,102,727 A | | 9/1963 | Rice | |
| 3,462,149 A | | 8/1969 | Grusin | |
| D221,452 S | | 8/1971 | Swanberg | |
| 3,870,309 A | * | 3/1975 | Tessier | A63B 67/14 473/587 |
| 3,927,885 A | | 12/1975 | Crossman et al. | |
| 4,183,536 A | | 1/1980 | Platt | |
| 4,846,475 A | | 7/1989 | Newcomb et al. | |

(Continued)

FOREIGN PATENT DOCUMENTS

| | | | | |
|---|---|---|---|---|
| CA | 3016076 A1 | * | 3/2019 | A63B 67/14 |
| CN | 201047515 Y | * | 4/2008 | |

(Continued)

OTHER PUBLICATIONS

Green Biscuit Alien [online]; [Retrieved on Aug. 5, 2020]; Retrieved from http://greenbiscuit.com/product/alien/.

(Continued)

*Primary Examiner* — Rajarshi Chakraborty
*Assistant Examiner* — Glenn D Zimmerman
(74) *Attorney, Agent, or Firm* — Woodard, Emhardt, Henry, Reeves & Wagner, LLP

(57) ABSTRACT

Certain embodiments of the present disclosure provide weights used as game pieces with shuffleboard game tables. The weights include an opaque base and a light transmissive cap. One or more lamps, such as LED lamps, are mounted within the weight to illuminate the game playing piece. A plurality of weights may be used on a shuffle game table.

20 Claims, 7 Drawing Sheets

(56) References Cited

U.S. PATENT DOCUMENTS

| | | | | |
|---|---|---|---|---|
| 4,968,036 | A | 11/1990 | Von Der Mark | |
| 5,695,420 | A | 12/1997 | Bellehumeur | |
| 5,697,858 | A | 12/1997 | Lekavich | |
| 5,720,651 | A | 2/1998 | Chien | |
| 6,059,676 | A | 5/2000 | Seymour et al. | |
| 6,126,561 | A | 10/2000 | Mark | |
| 6,217,468 | B1 | 4/2001 | Goodwin | |
| 6,866,268 | B2 | 3/2005 | Christianson | |
| 7,621,833 | B2 | 11/2009 | Proulx et al. | |
| 7,815,532 | B2 | 10/2010 | Harpell | |
| 7,900,921 | B1 | 3/2011 | Palmer et al. | |
| D651,657 | S | 1/2012 | Laporte et al. | |
| 8,764,592 | B2 | 7/2014 | Vanderberg | |
| 9,452,335 | B2 | 9/2016 | Vanderberg | |
| 9,463,360 | B1 | 10/2016 | Richard | |
| 2003/0119613 | A1 | 6/2003 | Samuel et al. | |
| 2004/0164488 | A1 | 8/2004 | Fitzgerald | |
| 2005/0130775 | A1 | 6/2005 | Hylak | |
| 2007/0275801 | A1 | 11/2007 | Proulx et al. | |
| 2010/0279804 | A1* | 11/2010 | Martin | A63F 7/0664 473/588 |
| 2011/0316228 | A1* | 12/2011 | Stites | A63D 3/00 273/126 R |
| 2012/0025459 | A1 | 2/2012 | Vanderberg | |
| 2012/0025460 | A1 | 2/2012 | Vanderberg | |
| 2012/0195052 | A1 | 8/2012 | Puskar-Pasewicz | |
| 2014/0309059 | A1 | 10/2014 | Minch | |
| 2017/0059286 | A1 | 3/2017 | D'Andrade | |
| 2020/0282279 | A1* | 9/2020 | Braun | A63F 7/0005 |

FOREIGN PATENT DOCUMENTS

| | | | | |
|---|---|---|---|---|
| CN | 207237207 | U | 4/2018 | |
| WO | WO-2017126961 | A1 * | 7/2017 | A63B 69/0046 |

OTHER PUBLICATIONS

The Comet Puck [online]; [Retrieved on Aug. 5, 2020]; Retrieved from www.thecometpuck.com.

* cited by examiner

LIGHTED SHUFFLEBOARD WEIGHT

FIELD OF THE DISCLOSURE

The disclosure is related to shuffleboard game tables, particularly a lighted shuffleboard weight for use with shuffleboard game tables.

BACKGROUND

People often enjoy physical exercises with the growing development of life standards. They may participate in a variety of sports, such as basketball, football, badminton, tennis, deck shuffleboard, etc. Such sports are often simulated with game tables for use in homes, arcades or similar recreational settings. The present disclosure deals with shuffleboard weights or game pieces for games which simulate deck shuffleboard on a raised table, sometimes referred to as table shuffleboard or indoor shuffleboard. The table includes a flat elevated smooth wooden surface which proportionately mimics the markings of a deck shuffleboard court. The table may define gutters with a lower height between the raised table surface and a peripheral railing.

Game pieces often called shuffleboard weights are typically used with shuffleboard game tables. Shuffleboard weights are usually made with a relatively heavy metal base, for example chrome-plated steel, and a light weight plastic top cap, for example made from ABS plastic. To play the game, the weight is typically gripped by a player and then propelled to slide across the playing surface toward the far end of the table. Weights are often indented or textured on the top to assist in being gripped. There are different styles of indentations, some have grooves all around the edge, while others have few or none. Single-color shuffleboard caps are most commonly used on shuffleboard weights. Red and blue are the most common colors.

It is desirable to have a game playing piece which enhances play.

SUMMARY OF THE DISCLOSURE

In certain embodiments, a weight for a table shuffleboard game includes a cylindrical base made of an opaque material. The base includes a lower end with a flat lower surface. The lower surface transitions via a radiused edge to an upward extending circular peripheral wall. An upper edge of the peripheral wall transitions to an upward facing surface. The base defines a base cavity defined by an interior lower surface and an interior peripheral wall. A cap is made of a light transmissive material. The cap includes a disc-shaped upper portion. The cap has an upper surface and a downward extending cap flange. The cap flange and the base are selectively matingly engagable to assemble the cap with the base. When assembled the base cavity and the cap cooperate to define an internal storage cavity. A circuit board is arranged in the internal storage cavity. At least one lamp is in the internal storage cavity and operably connected to the circuit board. The at least one lamp is arranged to emit visible light upward and outward through the cap. A switch is operably connected with the circuit board. The switch includes a button protruding through the cap. A power supply is arranged in the internal storage cavity and operably connected to the circuit board.

An alternate embodiment includes a table shuffleboard game with a set of weights. The game table includes a table bed elevated on a support structure. A playing surface is arranged on the upper side of the table bed and marked with shuffleboard game playing indicia. A peripheral railing extends around the game playing surface and a gutter extends between the playing surface and the railing. The game includes a set of at least eight weights to play shuffleboard on the game table. Each weight has a cylindrical base made of a steel. The base includes a lower end with a flat lower surface. The lower surface transitions via an edge to an upward extending circular peripheral wall. An upper edge of the peripheral wall transitions to an upward facing surface. The upward facing surface defines an opening to a base cavity defined by an interior lower surface and an interior peripheral wall. A helical thread protrudes inward from the interior peripheral wall. A cap is made of a light transmissive plastic. The cap includes a disc-shaped upper portion. The cap has an upper surface and a downward extending cap flange with an outward protruding helical thread. The helical thread of the cap is threadably engaged with the helical thread of the base to assemble the cap with the base. When assembled the base cavity and the cap cooperate to define an internal storage cavity. A circuit board is arranged in the internal storage cavity. A plurality of LED lamps are in the internal storage cavity and operably connected to the circuit board. the plurality of LED lamps are arranged to emit visible light to be transmitted upward and outward through the cap. A switch is operably connected with the circuit board. The switch includes a button protruding through the cap. A battery is arranged in the internal storage cavity and operably connected to the circuit board.

It is an object of certain embodiments of the present disclosure to provide a game piece.

Other objects and advantages of embodiments of the present disclosure will be apparent from the description, figures and claims.

DESCRIPTION OF ILLUSTRATED EMBODIMENTS

Figure 1:
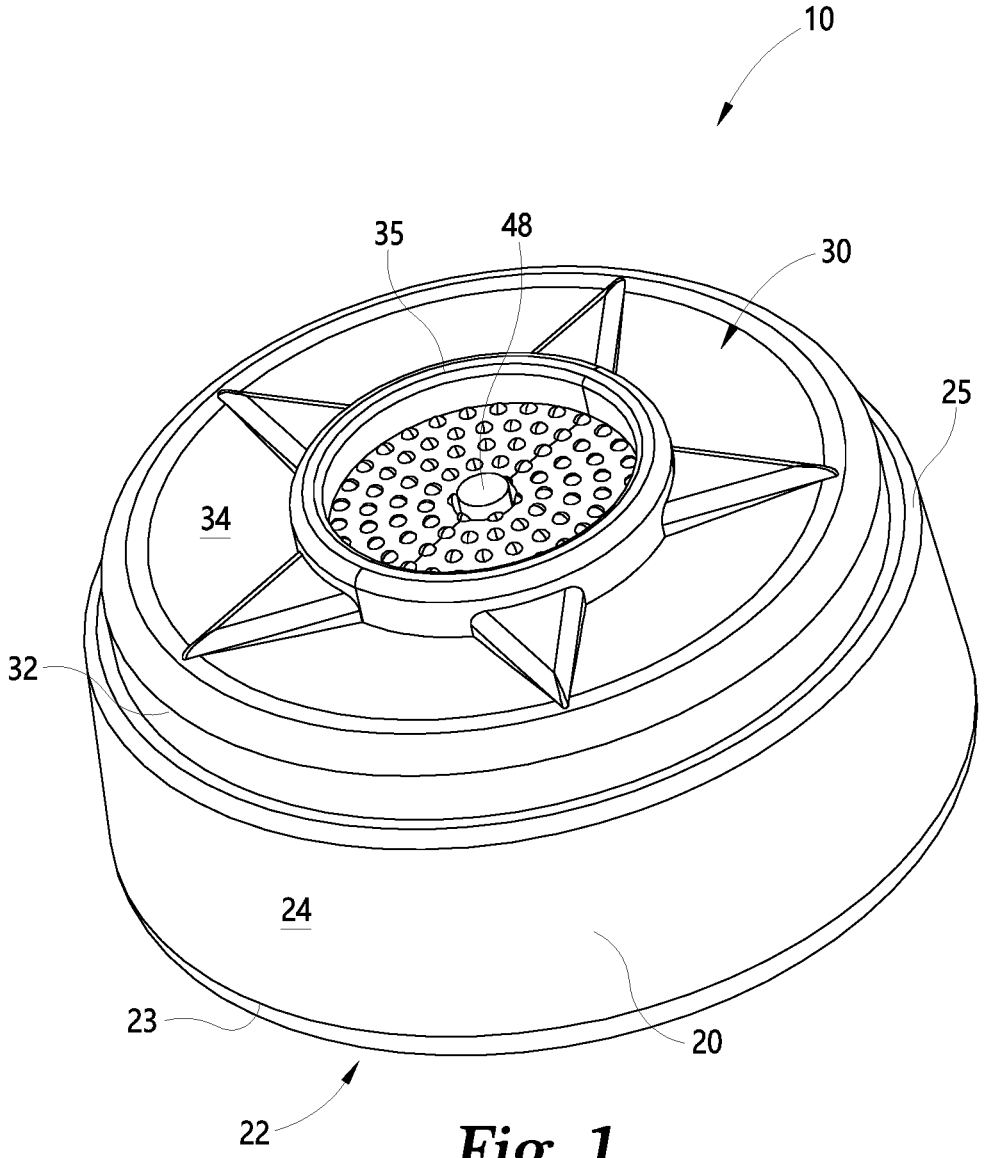
FIG. 1 is a perspective view of a lighted shuffleboard weight according to a representative embodiment of the disclosure.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, such alterations and further modifications in the illustrated device, and such further applications of the principles of the disclosure as illustrated therein are contemplated as would normally occur to one skilled in the art to which the disclosure relates.

Certain embodiments of the present disclosure provide game pieces used with simulated shuffleboard games which are typically game tables or games supported on tables. The game pieces or weights are designed to slide over the game playing surface. In certain embodiments, the game pieces incorporate one or more lamps, such as LED lamps, to illuminate the caps of the game playing pieces. Among other benefits, the lighted shuffleboard weight provide improved visibility and aesthetics during use in lighted or low-light environments.

Top, bottom, face and vertical references herein are from the perspective of a game piece to be used on a game playing surface. Directional references are for ease of illustration and are not intended to be limiting.

FIGS. 1-6 illustrate an example embodiment of a game piece which is a lighted shuffleboard weight 10. Weight 10 includes a base 20 and a cap 30. Base 20 is typically made as a single piece metal mass to provide weight, such as chrome-plated steel. Alternate metals could be aluminum or titanium, or a metal coating on a base. Base 20 is made of an opaque material, meaning it does not transmit light. Cap 30 is formed of plastic, for example an ABS plastic. In the disclosed embodiments, cap 30 is formed of a light transmissive material, allowing light from interior lamps to pass upward and outward through the cap. Typically cap is made of one piece of a uniform material. Cap 30 may be transparent or translucent. Optionally, cap 30 may be tinted or untinted.

Figure 2:
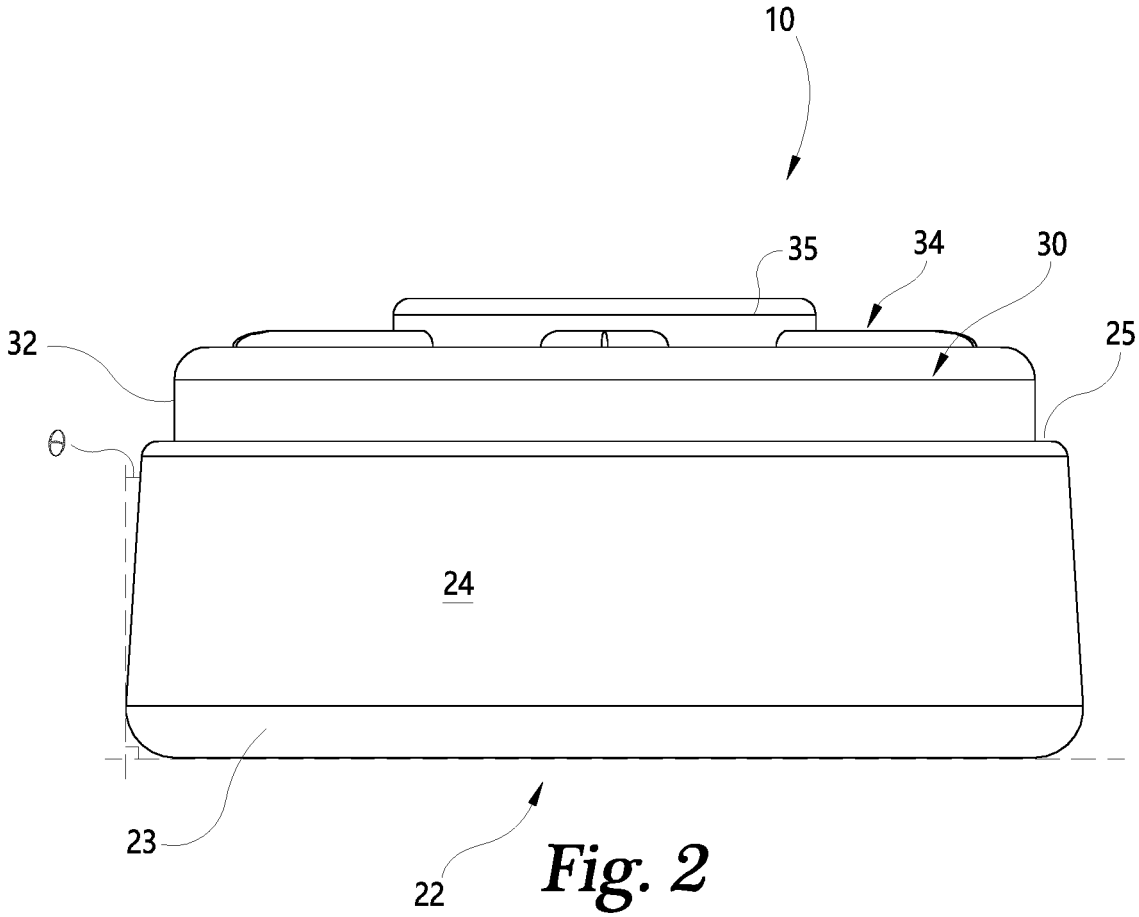
FIG. 2 illustrates a side view of the embodiment of FIG. 1.
Figure 3:
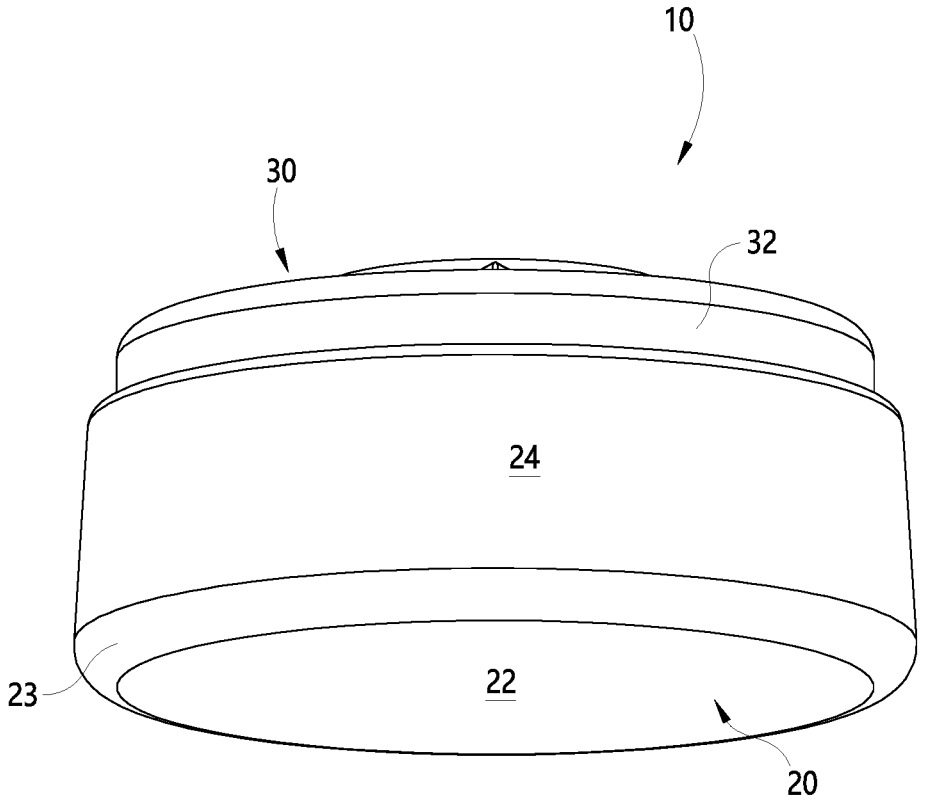
FIG. 3 illustrates a perspective lower view of the embodiment of FIG. 1.
Figure 4:
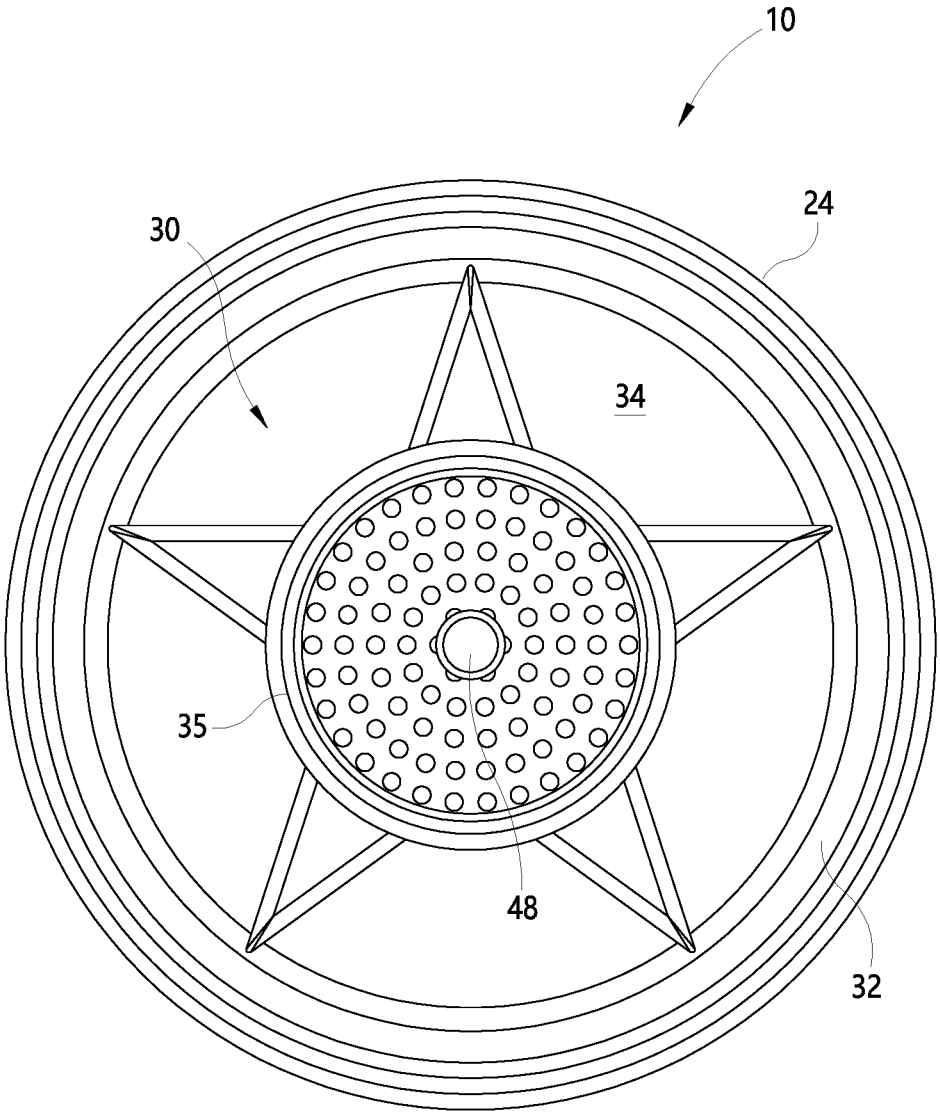
FIG. 4 illustrates a top view of the embodiment of FIG. 1.

Base 20 is broadly in the shape of a cylinder. The lower end of base 20 is closed and includes a smooth, flat lower surface 22 suitable to slide on a game playing surface. Lower surface 22 transitions to an upward extending circular peripheral wall 24, preferably via a radiused edge 23. In some embodiments circular peripheral wall 24 is substantially vertical. In alternate embodiments, as illustrated in FIG. 2, peripheral wall 24 may optionally be slightly tapered inward between its lower edge and its upper edge so that the diameter of the upper edge of peripheral wall 24 is slightly less than the diameter of the lower edge. The tapered profile of peripheral wall 24 is illustrated as diverging a few degrees from vertical by angle θ. In still further embodiments, the circular peripheral wall 24 may be outwardly curved in an arc along the cylinder height, with the largest diameter at a central height.

Figure 5:
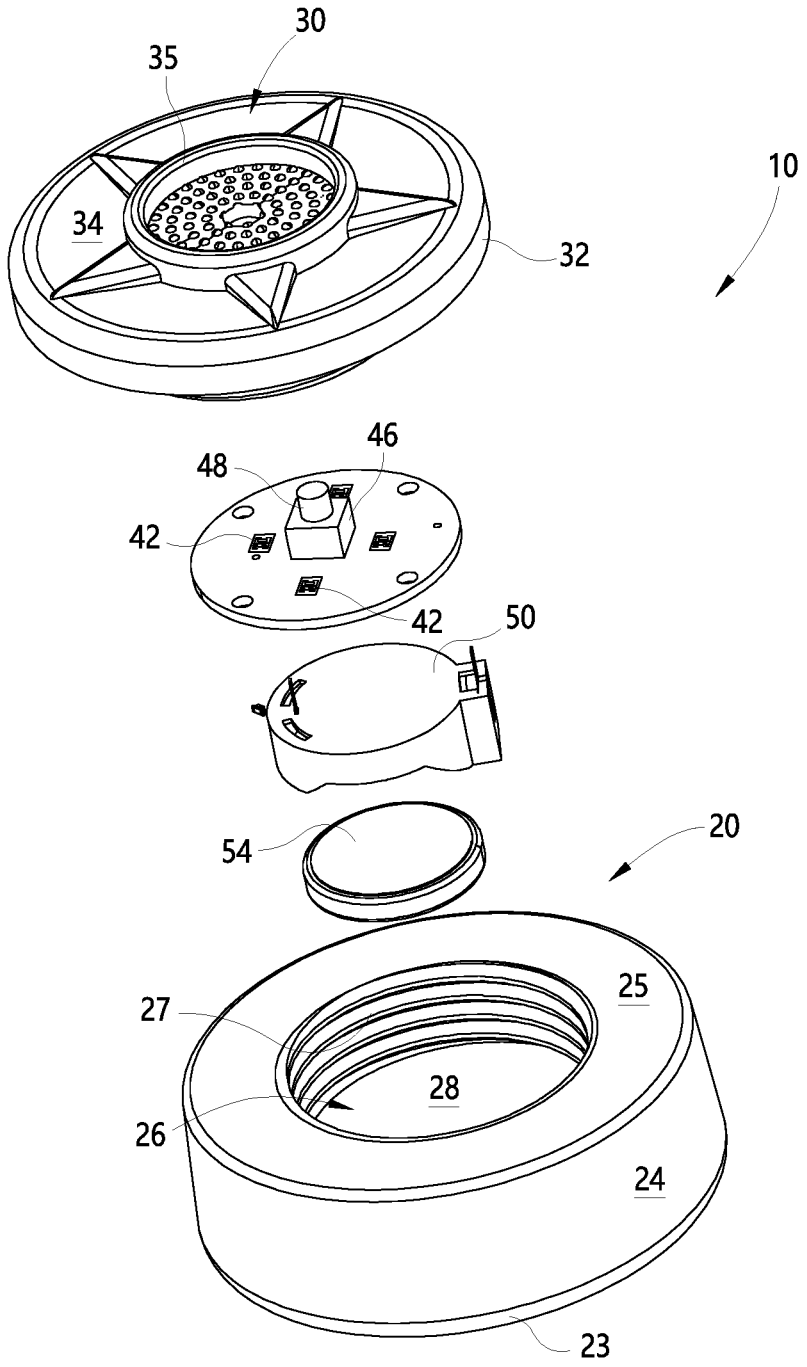
FIG. 5 illustrates a perspective exploded view of the embodiment of FIG. 1.

As visible in FIG. 5, the upper edge of peripheral wall 24 transitions, for instance via a radiused edge, to an upward facing top surface 25. In the illustrated embodiment, top surface 25 is ring shaped and defines the opening to an internal base cavity or bore 26 surrounded by an interior peripheral wall. Base cavity 26 may be cylindrical. Base cavity 26 includes an interior lower surface 28. A helical thread 27 protrudes inward from the interior peripheral wall of base cavity 26. The base thickness between outer peripheral wall 24 and base cavity 26 defines the width of ring-shaped surface 25.

The upper portion of weight 10 is formed with cap 30. Cap 30 includes a disc-shaped upper portion with a circular sidewall 32 and upper surface 34. Cap 30 may include an upward protruding pattern or texture 35, for instance illustrated as an inner ring and a series of radial triangular portions forming a star shaped pattern. Optionally, various patterns may be used or a protruding pattern may be omitted. In certain embodiments, the outer diameter of cap 30 is slightly smaller than the outer diameter of ring-shaped surface 25, so that cap 30 is indented from base 20.

Figure 6:
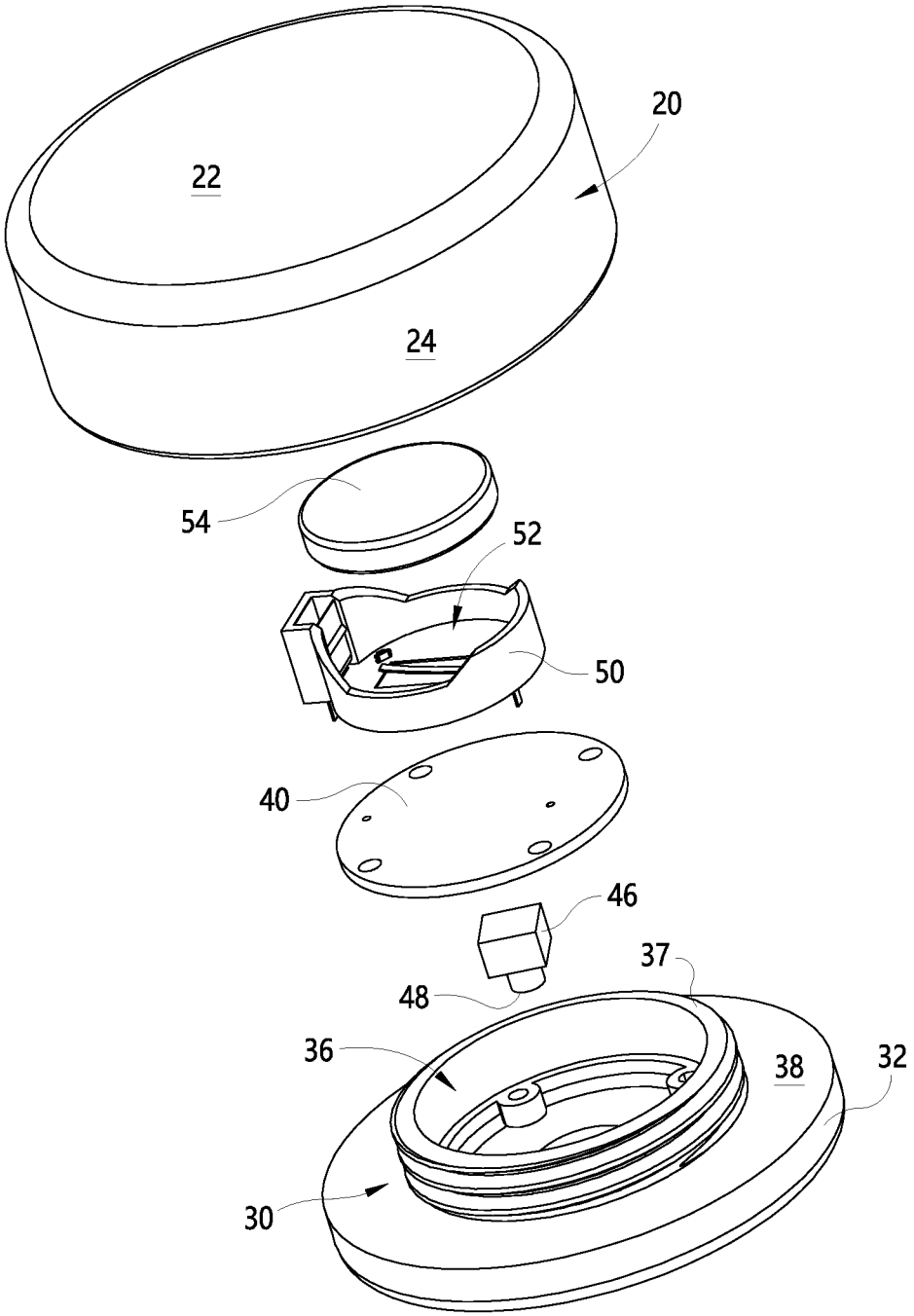
FIG. 6 illustrates an alternate perspective of the exploded view of FIG. 5.

As is visible in FIG. 6, cap 30 defines an interior cylindrical cap cavity or bore 36 defined by downward extending flange 37 and closed by upper surface 34. In the illustrated embodiment, flange 37 is circular. Circular flange 37 includes an outward protruding helical thread. Circular flange 37 and the outward extending thread are sized and configured to extend into and matingly engage the internal cavity 26 of base 20 and helical thread 27. Base 20 and cap 30 may be selectively assembled and disassembled by matingly engaging or disengaging cap flange 37 with base cavity 26. Base cavity 26 and cap cavity 36 cooperate to define an internal storage cavity. When assembled, lower surface 38 of cap 30 may partially overlap and abut upper surface 25 of base 20.

Cavities 26 and 36 are illustrated as circular, although other shapes may be used. Correspondingly, other arrangements may be used for matingly engaging cap 30 to base 20. Examples include using mechanical fasteners such as screws or snaps, hook and loop fasteners, a snap fit, a tab-in-slot connection or a friction fit, among other options. Preferably although not necessarily, cap 30 is removable from base 20 to allow access to the interior components, for example to allow the battery to be replaced. Alternately, an internal power source could be recharged via a wired or wireless connection without disassembling weight 10.

Figure 7:
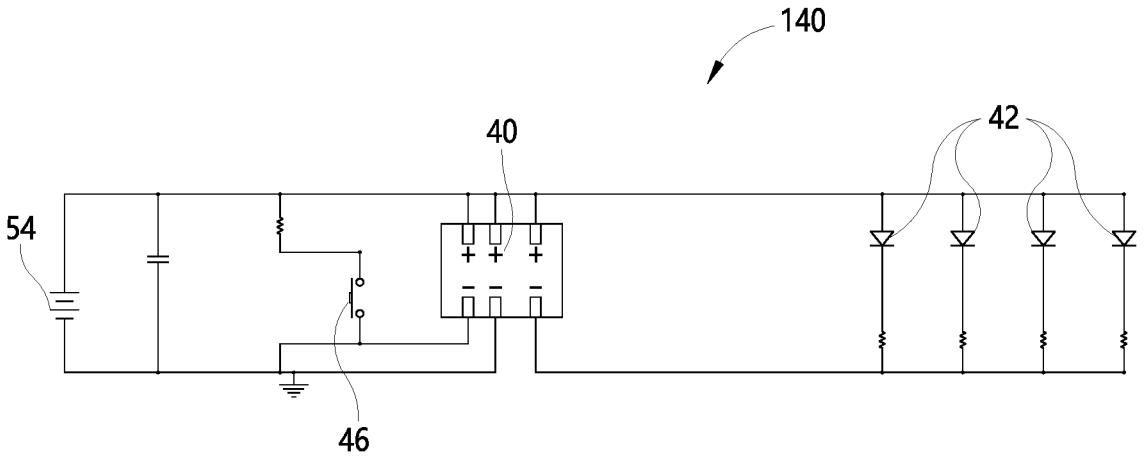
FIG. 7 illustrates a schematic diagram of the electronic components incorporated in the embodiment of FIG. 1.

Electronic circuitry 140 and components for weight 10 are nested and enclosed within the internal storage cavity defined by base 20 and cap 30 between lower surface 28 and cap surface 34. A schematic diagram of electronic circuitry 140 is illustrated in FIG. 7. In certain embodiments the cavity may provide room to selectively add mass to adjust how heavy the weight is. The electronic circuitry 140 includes circuit board 40. One or more LED lamps 42 are operably mounted to the upper side of circuit board 40. In alternatives other types of lamps can be used. The illustrated embodiment includes four LED lamps equally spaced around the perimeter of circuit board 40, yet more or fewer lamps 42 can be used as desired. Lamps 42 are arranged to emit visible light to be transmitted upward and outward through cap 30. Preferably yet optionally, light is transmitted outward across substantially the entire diameter of the cap. If cap 30 is transparent, lamps 42 may be directly visible. Alternately, in a wholly or partially translucent version, cap 30 may internally reflect and/or refract the emitted light. In certain embodiments the textured portion of cap 30 contributes to refracting emitted light. In certain embodiments the lamps 42 are colored to provide specific light colors. Alternately, the lamps may include multiple color options which can be controlled by the player. For instance, in some embodiments the lamp color can be controlled by the player so that, as needed, a weight 10 matches either a first team color, such as red, or a second team color, such as blue.

A switch 46 is operably connected to the upper side of the circuit board 40. In the illustrated embodiment, switch 46 includes a control button 48 which extends upward through an opening in cap 30 to make it externally accessible. A user can operate switch 46 to control circuit board 40 and correspondingly lamps 42. Preferably yet optionally, the height of button 48 is less than the height of upward protruding pattern 35. In alternate embodiments a remote control or other external wired or wireless device may be used to control circuit board 40 and lamps 42. Electronic circuitry 140 may include other components such as resistors and capacitors as would be understood by those of skill in the art.

Circuit board 40 may be programmed with a simple on/off functionality for all of the lamps 42. In other embodiments, circuit board 40 may be programmed so that successively depressing control button 48 selects a lamp color, selects a light pattern such as blinking, or a random pattern. The programming may control the lamps simultaneously or individually, for example sequentially or in a motion that appears to skip from one lamp to another.

A battery case 50 is operatively mounted to the lower side of circuit board 40. Battery case 50 includes an interior cavity 52 and electrical contacts arranged to receive, engage and retain a battery 54 or a similar power supply. In the illustrated embodiment a coin or button cell style of battery 54 is used. Preferably, the mass of the components within weight 10 is distributed to not affect the center of gravity of weight 10.

Preferably the weight 10 has an industry standard size and weight, but variations in size and weight will be understood by those of skill in the art. For purposes of illustration, non-limiting dimensions are described. For example large or regulation size weights measure 2⁵⁄₁₆ inches in diameter and weigh between 10.9 and 12.5 ounces. Medium weights, commonly used in the home market, are 2½ inches in diameter and weigh between 9.5 and 15 ounces. Weights generally are three-quarters of an inch in height, without the cap.

Figure 8:
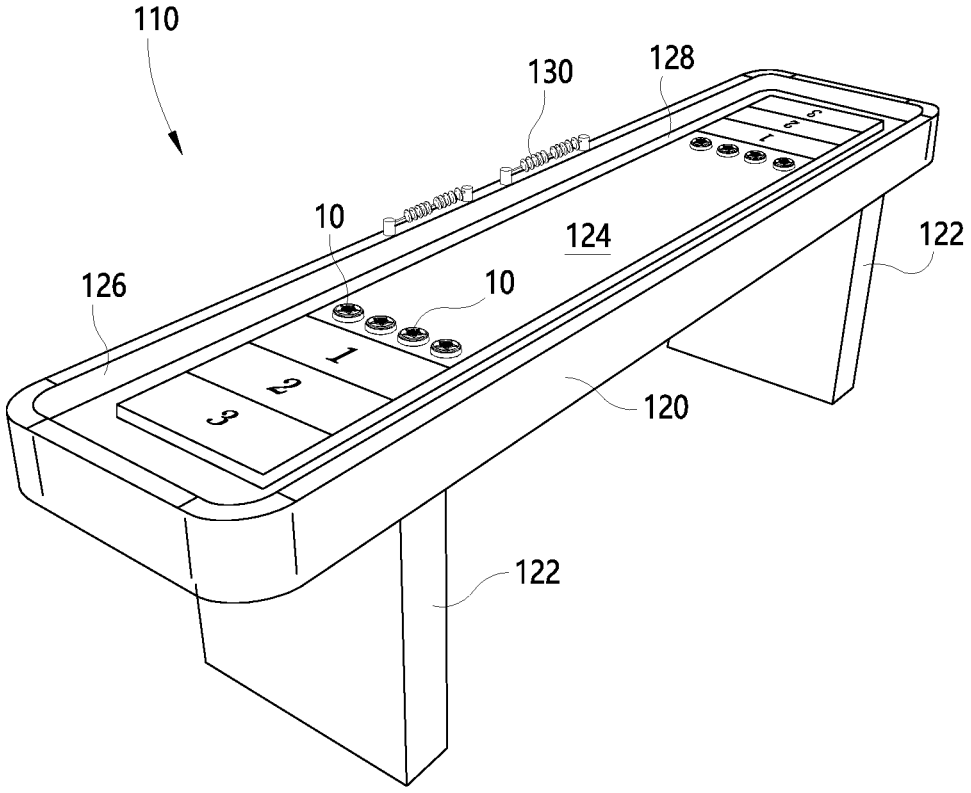
FIG. 8 illustrates an embodiment of several lighted shuffleboard weights on a representative shuffleboard game table.

As illustrated in FIG. 8, a plurality or series of weights 10 according the disclosures herein are used in conjunction with a game table 110 to play a game of shuffleboard. A typical set includes eight weights, with four in a first color and four in a second color. A representative shuffleboard game table 110 has a table bed 120 elevated on a support structure such as legs 122. Shuffleboard tables typically range between eight and twenty-two feet in length and are at least twenty inches wide. Regulation shuffleboard tables are twenty-two feet in length. Shuffleboard tables for the home market are commonly between eight and twelve feet in length.

A playing surface 124 is arranged on the upper side of bed 120. The playing surface is marked with game playing indicia such as scoring area lines and area numbers. Playing surface 124 is typically rectangular and made of wood. Commonly, the surface is solid and polished to minimize friction between game pieces and the playing surface. Table bed 120 includes a peripheral railing 126 extending around playing surface 124. In some embodiments, playing surface 124 is raised relative to a peripheral gutter 128 which extends between playing surface 124 and railing 126. During game play, each player uses four shuffleboard weights 10, with each player having four weights of the same color, for instance four red weights and four blue weights. The weights 10 of the present disclosure are usable with various types of shuffleboard game tables. Players may keep scoring using a scoring or tally mechanism 130.

While the disclosure has been illustrated and described in detail in the drawings and foregoing description, the same is to be considered as illustrative and not restrictive in character, it being understood that only the preferred embodiments have been shown and described and that all changes and modifications that come within the spirit of the disclosure are desired to be protected.

What is claimed is:

1. A weight for a table shuffleboard game, comprising:

a cylindrical base made of steel, the base including a lower end with a flat lower surface, the lower surface transitioning via a radiused edge to an upward extending circular peripheral wall, an upper edge of the peripheral wall transitioning to an upward facing surface, the base defining a base cavity defined by an interior lower surface and a circular interior peripheral wall with an inward protruding helical thread;

a cap made of a light transmissive material, the cap including a disc-shaped upper portion, the cap having an upper surface and a downward extending circular cap flange with an outward protruding helical thread;

wherein the helical thread of the cap flange and the helical thread of the base are selectively threadably engagable to assemble the cap with the base and wherein when assembled the base cavity and the cap cooperate to define an internal storage cavity;

a circuit board arranged in the internal storage cavity;

at least one lamp in the internal storage cavity and operably connected to the circuit board, the at least one lamp arranged to emit visible light to be transmitted upward and outward through the cap;

a switch operably connected with the circuit board, the switch including a button protruding through the cap; and a power supply arranged in the internal storage cavity and operably connected to the circuit board.

2. The weight of claim 1, wherein the base is made of steel and the cap is made of plastic.

3. The weight of claim 1 wherein the at least one lamp comprises a plurality of lamps operably connected to the circuit board.

4. The weight of claim 1, wherein the cap is transparent.

5. The weight of claim 1, where the cap is translucent.

6. The weight of claim 1, wherein the circular peripheral wall of the base tapers inward as it extends upward so that the diameter of the upper edge is less than the diameter of the lower edge.

7. The weight of claim 1, where the at least one lamp is colored red or blue.

8. The weight of claim 1, where the color of the at least one lamp can be changed from red to blue or from blue to red using the switch.

9. The weight of claim 1, where the cap is tinted red or blue.

10. The weight of claim 2, wherein the cap has an outer diameter less than an outer diameter of the upper edge of the peripheral wall of the base.

11. The weight of claim 2, wherein the base cavity peripheral wall is circular and includes an inward protruding helical thread; wherein the flange of the cap is circular and includes an outward protruding helical thread; and wherein the helical thread of the cap is threadably engaged with the helical thread of the base.

12. The weight of claim 3, wherein the lamps are LED lamps.

13. The weight of claim 5, wherein cap includes a textured pattern that refracts light emitted by the at least one lamp.

14. A weight for a table shuffleboard game, comprising a cylindrical base made of a steel, the base including a lower end with a flat lower surface, the lower surface transitioning via a lower edge to an upward extending circular peripheral wall, a top surface of the base defines an opening to a base cavity defined by an interior lower surface and an interior peripheral wall with a helical thread protruding inward from the interior peripheral wall;

a cap made of a light transmissive plastic, the cap including a disc-shaped upper portion, the cap having an upper surface and a downward extending flange with an outward protruding helical thread;

wherein the helical thread of the cap is threadably engaged with the helical thread of the base to assemble the cap with the base, wherein the cap has an outer diameter less than the outer diameter of an upper edge of the peripheral wall of the base, and wherein when assembled the base and cap cooperate to define an internal storage cavity;

a circuit board arranged in the internal storage cavity;

a plurality of LED lamps in the internal storage cavity and operably connected to the circuit board, the plurality of LED lamps arranged to emit visible light to be transmitted upward and outward through the cap;

a switch operably connected with the circuit board, the switch including a button protruding through the cap; and a battery arranged in the internal storage cavity and operably connected to the circuit board.

15. The weight of claim 14, wherein the circular peripheral wall of the base tapers inward as it extends upward so that the diameter of an upper edge is less than the diameter of the lower edge.

16. A table shuffleboard game comprising:

a game table with a table bed elevated on a support structure;

a playing surface arranged on an upper side of the table bed and marked with shuffleboard game playing indicia;

a peripheral railing extending around the playing surface and a gutter which extends between the playing surface and the railing;

a set of at least eight weights to play shuffleboard on the game table, each weight having:

a cylindrical base made of a steel, the base including a lower end with a flat lower surface, the lower surface transitioning via an edge to an upward extending circular peripheral wall, an upper edge of the peripheral wall transitioning to an upward facing surface, the upward facing surface defining an opening to a base cavity defined by an interior lower surface and an interior peripheral wall with a helical thread protruding inward from the interior peripheral wall;

a cap made of a light transmissive plastic, the cap including a disc-shaped upper portion, the cap having an upper surface and a downward extending cap flange with an outward protruding helical thread;

wherein the helical thread of the cap is threadably engaged with the helical thread of the base to assemble the cap with the base and wherein when assembled the base cavity and the cap cooperate to define an internal storage cavity;

a circuit board arranged in the internal storage cavity;

a plurality of LED lamps in the internal storage cavity and operably connected to the circuit board, the plurality of LED lamps arranged to emit visible light to be transmitted upward and outward through the cap;

a switch operably connected with the circuit board, the switch including a button protruding through the cap; and a battery arranged in the internal storage cavity and operably connected to the circuit board.

17. The game table of claim 16, wherein the plurality of LED lamps in each weight are colored red or blue.

18. The game table of claim 16, where the cap on each weight is tinted red or blue.

19. The game table of claim 16, where the base of each weight is formed as a single piece of steel.

20. The game table of claim 17, wherein the plurality of LED lamps in each weight can be changed from red to blue or from blue to red.

* * * * *